US005318189A

United States Patent [19]

Lee

[11] Patent Number: 5,318,189

[45] Date of Patent: Jun. 7, 1994

[54] COAT RACK

[76] Inventor: Cheol J. Lee, 1130-52, Guro 3-dong, Guro-gu, Seoul, Rep. of Korea

[21] Appl. No.: 970,821

[22] Filed: Nov. 3, 1992

[30] Foreign Application Priority Data

Feb. 24, 1992 [KR] Rep. of Korea ..... 2763/1992

[51] Int. Cl.[5] ..... A47F 7/00

[52] U.S. Cl. ..... 211/205; 211/196

[58] Field of Search ..... 211/205, 204, 196, 163

[56] References Cited

U.S. PATENT DOCUMENTS 3,197,034 7/1965 Deadrick ..... 211/205

4,889,246 12/1989 Lee ..... 211/205 X 5,219,081 6/1993 Lin ..... 211/205

*Primary Examiner*—Alvin C. Chin-Shue

*Assistant Examiner*—Sarah A. Lechok

*Attorney, Agent, or Firm*—Merchant, Gould, Smith, Edell, Welter & Schmidt

[57] ABSTRACT

A coat rack comprising replaceable rack pieces rotatably mounted on a pillar rod and having stationary pieces disposed between each rack piece, an ornamental top mounted to an uppermost stationary piece held in place by a hollow square piece and a corresponding cap piece.

1 Claim, 2 Drawing Sheets

COAT RACK

FIELD OF THE INVENTION

The present invention generally relates to a coat rack and more particularly is directed to the provision of a plurality of replaceable components in order to extend the life of the product.

BACKGROUND OF THE INVENTION

An ordinary coat rack now widely used comprises only a few stationary pieces such that if even one of the pieces is broken while moving it the whole rack has to be thrown away in spite of the economic loss.

It is accordingly a primary object of the present invention to provide a coat rack that overcomes the foregoing problem associated with the prior art.

Another object of the present invention is to provide a coat rack in which is easy to replace broken or damaged rack pieces. A further object of the present invention is to provide a coat rack wherein the rack pieces having various configurations and forms can be simply inserted and assembled in the pillar rod, if necessary.

A further object of the present invention is to provide a coat rack having a top which is aesthetically beautiful in appearance.

The foregoing and other objects as well a advantages of the present invention will become clear by the following description of the invention with reference to the accompanying drawings.

DESCRIPTION OF THE PREFERRED EMBODIMENT

Figure 1:
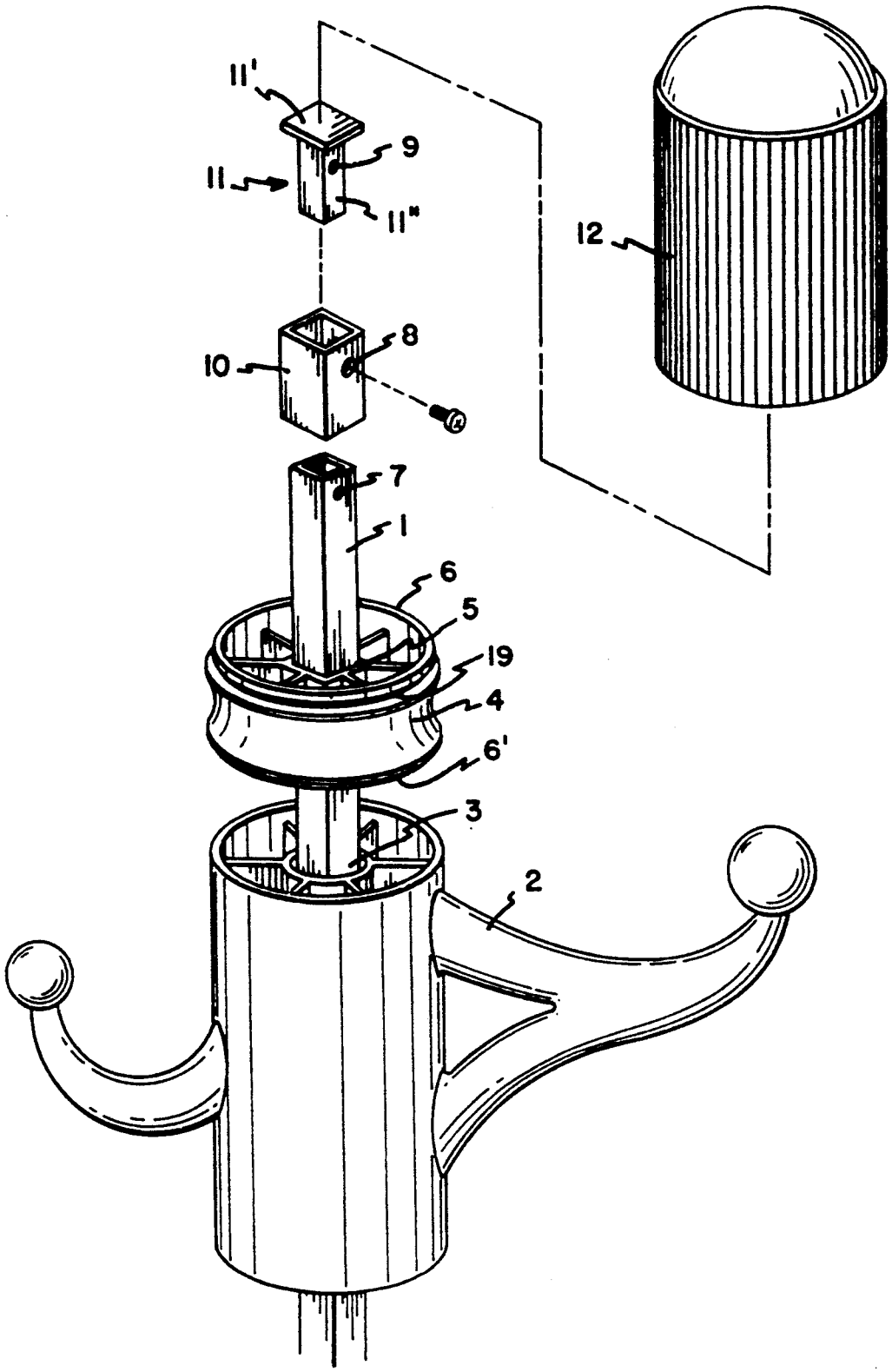
FIG. 1 is an exploded view of the principal part of the present invention.
Figure 3:
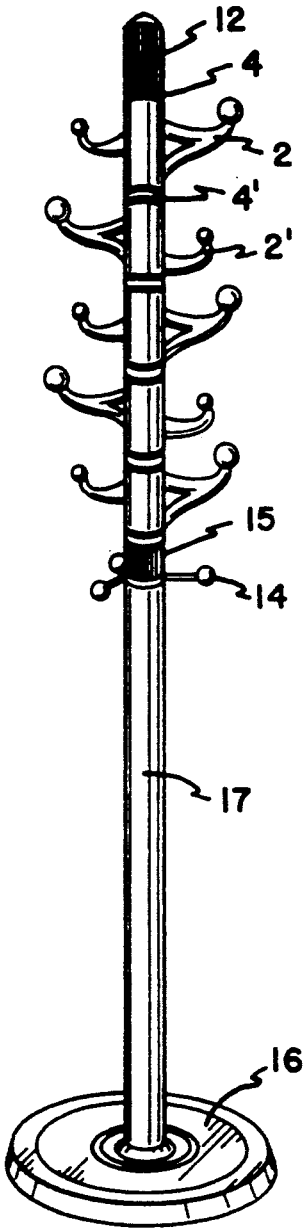
FIG. 3 is a perspective view of the present invention.
Figure 2:
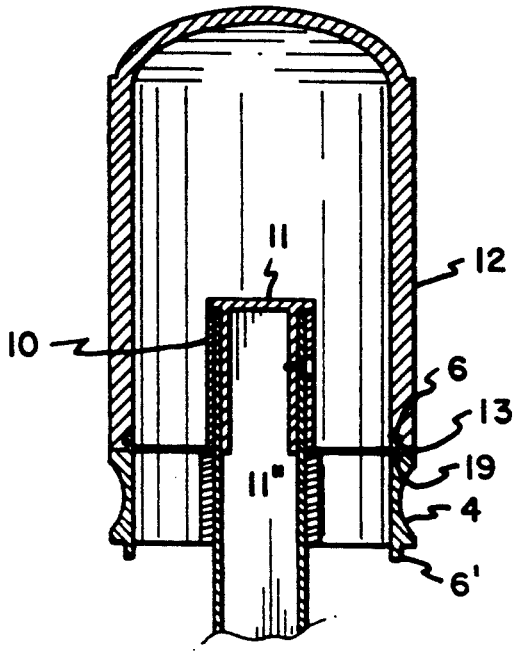
FIG. 2 is a section view showing the assembly of the top pieces of the present invention.

An embodiment of a coat rack according to the present invention will hereinafter be described with reference to FIGS. 1 to 3.

A stem pillar 17 fixed upright on the center position of a floor plate 16 has a fixed rack 14 mounted on top of the pillar 17 above which is mounted an ornamental cylinder piece 15. Fixed to the cylinder piece 15 is a square hollow pillar rod 1 extending to the top of the present invention.

Centered o the pillar rod 1 are a plurality of rack pieces 2, 2' having a central hole 3 with a diameter larger than that of the pillar rod 1. Stationary pieces 4, 4' are installed between each rack piece 2, 2'. The stationary pieces 4, 4' have a square hole 5 through which the pillar rod 1 is inserted and also having circular insertion portions 6, 6' which mate with the open ends of the rack pieces 2, 2' over the upper most stationary piece 4, a hollow square piece 10 having a bolt hole 8 is installed over the pillar rod 1, and then a square cap piece 11 having a square head 11', square tube 11'' and a bolt hole 9 is installed. The hollow square piece 10, the square cap piece 11 and the top of the said pillar rod 1 are fixed through the holes 7, 8, 9 by means of a bolt. At the last stage of assembly of the present invention, a hollow ornamental top cap 12 is force-fitted by the bottom synthetic resin projecting piece 13 onto the concave groove 19 of the insertion portion 6 formed on top of the uppermost stationary piece 4.

The present invention features the replaceable racks combined with the bottom fixed rack and the corresponding fastening devices for assembly and disassembly Therefore, the whole of it need not be thrown away even if a part of it is broken or damaged. The broken or damaged pieces may be economically replaced instead of disposing of them.

The above description is given on a single preferred embodiment of the invention; however, it will be apparent that modifications and variations could be effected by one skilled in the art without departing from the spirit or scope of the novel concepts of the invention as defined in the appended claims.

What is claimed is:

1. A coat rack comprising:

a stem pillar fixed upright on a center position of a floor plate, a fixed rack and an ornamental cylinder piece installed respectively on a top end of the stem pillar, a square hollow pillar rod fixed to and extending axially from the top end of the ornamental cylinder piece and having a first mounting hole formed proximate the top end thereof, a plurality of rotatable rack pieces each having a central hole formed therein through which the pillar rod is inserted, a plurality of stationary pieces having a square hole for insertion of the pillar rod and insertion portions on top and bottom edges of each of the stationary pieces, said insertion portions having a concave groove, said stationary pieces being installed on the pillar rod alternately between each of the rack pieces, a hollow square piece having ak second mounting hole formed in a side thereof, a square cap piece having ak third mounting hole formed in a side thereof and having a square head, the square piece and the cap piece are installed at the top end of the pillar rod and fastened by a bolt through the first, second, and third mounting holes, and a hollow ornamental top having a synthetic resin projecting piece formed in a bottom end thereof, the projecting piece forcibly-fitting onto the concave groove of the insertion portion of the uppermost of the stationary pieces.

* * * * *